US008581796B2

(12) United States Patent
Ryou et al.

(10) Patent No.: US 8,581,796 B2
(45) Date of Patent: Nov. 12, 2013

(54) ANTENNA USING COMPLEX STRUCTURE HAVING PERIODIC, VERTICAL SPACING BETWEEN DIELECTRIC AND MAGNETIC SUBSTANCES

(75) Inventors: Byung Hoon Ryou, Seoul (KR); Won Mo Sung, Siheung-si (KR); Jeong Keun Ji, Seoul (KR)

(73) Assignee: EMW Co., Ltd., Incheon (KR)

( * ) Notice: Subject to any disclaimer, the term of this patent is extended or adjusted under 35 U.S.C. 154(b) by 343 days.

(21) Appl. No.: 13/054,786

(22) PCT Filed: Jul. 20, 2009

(86) PCT No.: PCT/KR2009/004005

§ 371 (c)(1), (2), (4) Date: Apr. 15, 2011

(87) PCT Pub. No.: WO2010/008256

PCT Pub. Date: Jan. 21, 2010

(65) Prior Publication Data

US 2011/0193760 A1 Aug. 11, 2011

(30) Foreign Application Priority Data

Jul. 18, 2008 (KR) ..... 10-2008-0069884
Jul. 18, 2008 (KR) ..... 10-2008-0069885

(51) Int. Cl.
*H01Q 1/00* (2006.01)

(52) U.S. Cl.
USPC ..... 343/787; 343/771

(58) Field of Classification Search
USPC ..... 343/787, 202, 771, 702, 322, 318
See application file for complete search history.

(56) References Cited

U.S. PATENT DOCUMENTS

| | | | | |
|---|---|---|---|---|
| 5,159,347 | A * | 10/1992 | Osterwalder | 343/787 |
| 5,416,492 | A * | 5/1995 | Takahashi et al. | 343/771 |
| 5,448,252 | A * | 9/1995 | Ali et al. | 343/700 MS |
| 6,414,639 | B1 * | 7/2002 | Iio | 343/702 |
| 6,771,070 | B2 * | 8/2004 | Lee | 324/318 |
| 6,791,496 | B1 | 9/2004 | Killen et al. | |
| 2007/0001921 | A1 | 1/2007 | Takahashi et al. | |
| 2008/0143626 | A1 | 6/2008 | Kim et al. | |
| 2010/0213941 | A1 * | 8/2010 | Driesel et al. | 324/322 |
| 2011/0084782 | A1 * | 4/2011 | Kanno | 333/202 |

FOREIGN PATENT DOCUMENTS

KR 1020050006564 1/2005

OTHER PUBLICATIONS

PCT International Search Report for PCT Counterpart Application No. PCT/KR2009/004005 containing Communication relating to the Results of the Partial International Search Report, 4 pgs., (Feb. 2, 2010).

* cited by examiner

*Primary Examiner* — Thien M Le
(74) *Attorney, Agent, or Firm* — The PL Law Group, PLLC

(57) ABSTRACT

The present invention relates to an antenna using a complex structure in which dielectric substances having a low dielectric constant and magnetic substances having a high magnetic permeability are arranged vertically and periodically in order to improve the gain, efficiency, and bandwidth of the antenna while maintaining a small size which is an advantage of a conventional antenna using dielectric substances having a high dielectric constant. The present invention provides the antenna using a complex structure having a vertical and periodic structure of dielectric substances and magnetic substances, comprising a substrate and a radiation patch formed on the substrate. The substrate includes a plurality of layers. Each of the layers has the dielectric substances and the magnetic substances of a bar shape alternately arranged therein and has the dielectric substances and the magnetic substances alternately laminated thereon even in a height direction.

10 Claims, 9 Drawing Sheets

ANTENNA USING COMPLEX STRUCTURE HAVING PERIODIC, VERTICAL SPACING BETWEEN DIELECTRIC AND MAGNETIC SUBSTANCES

CROSS-REFERENCE TO RELATED APPLICATIONS

This patent application is a U.S. National Phase application under 35 U.S.C. §371 of International Application No. PCT/KR2009/004005, filed on Jul. 20, 2009, entitled ANTENNA USING COMPLEX STRUCTURE HAVING PERIODIC, VERTICAL SPACING BETWEEN DIELECTRIC AND MAGNETIC SUBSTANCES, which claims priority to Korean patent application number 10-2008-0069885, filed Jul. 18, 2008 and Korean patent application number 10-2008-0069884, filed Jul. 18, 2008.

TECHNICAL FIELD

The present invention relates to an antenna using a complex structure in which dielectric substances having a low dielectric constant and magnetic substances having a high magnetic permeability are arranged vertically and periodically in order to improve the gain, efficiency, and bandwidth of the antenna while maintaining a small size which is an advantage of a conventional antenna using dielectric substances having a high dielectric constant.

BACKGROUND ART

Several digital multimedia broadcasting systems including terrestrial wave DMB has recently just started being served in earnest. In preparation for the service, the development of portable terminals capable of receiving Digital Multimedia Broadcasting (DMB), as well as the broadcasting systems, is being developed.

Furthermore, a complex type terminal capable of receiving two kinds of services through one portable terminal is actively being developed in conjunction with the existing mobile phone system.

However, the frequency bands used in the DMBs are 174 to 216 MHz which is chiefly a low frequency band, such as UHF or VHF. Accordingly, there are several restrictions to the development of portable terminals.

The most significant restriction is a problem relating to the size of an antenna basically used in the portable terminal.

In general, the size of the antenna is increased with a used frequency being lowered. In order to fabricate an antenna for a UHF or VHF band, a length of several tens of cm is required. However, the antenna is not suitable to be used in the portable terminal. Accordingly, active research is being done on a reduction in the size of an antenna for the portable terminal.

The existing whip antenna or helical antenna of a monopole type is configured to protrude externally from the portable terminal, and thus the use of the antenna of this type is decreased. There is a lot of interest in a built-in type antenna which is fully put in the portable terminal and not externally protruded, and various portable terminals using the built-in type antenna are emerging.

One of the built-in type antennas is a Printed Circuit Board Antenna (hereinafter referred to as a 'PCB antenna').

The PCB antenna is characterized in that the shape of the antenna is chiefly flat. The PCB antenna can be easily implemented with a low cost and can solve problems in the process, as compared with a coil type antenna.

FIG. 1A is a plan view of a PCB antenna which is a conventional built-in type antenna and, FIG. 1B is a cross-sectional view taken along line I-I' of the plan view.

Referring to FIGS. 1A and 1B, the existing PCB antenna includes a PCB 10 having the components of a portable terminal mounted thereon and an antenna pattern 20 serving as a radiation substance patterned on the PCB 10 in a specific form. In general, a material chiefly used in the PCB is FR4, and the antenna pattern is printed using copper (Cu).

However, the PCB antenna (that is, the built-in type antenna) shown in FIGS. 1A and 1B also does not deviate from a correlation between the frequency and the size of the antenna, and thus the existing built-in type antenna has a very large size. In view of a trend toward a reduction in the size of and an increase in the functions of a current portable terminal, the built-in type antenna is also becoming a major factor to restrict a reduction in the size of the portable terminal.

In particular, a portable terminal for DMB operates in a low frequency band of 174 to 216 MHz, such as UHF or VHF, and has lots of difficulties in using the existing PCB antenna, such as that shown in FIGS. 1A and 1B. Accordingly, there is an urgent need for an antenna having a size more and more reduced In order to solve the problems, a technique for constructing a substrate using high dielectric substances and forming a radiation pattern on the substrate has been developed and used. However, in the case where an antenna is implemented using high dielectric substances, a reduction in the size of the antenna may be achieved, but a disadvantage in that the gain and bandwidth of the antenna are decreased is inevitable.

The antenna using high dielectric substances as described above is not suitable for several DMB systems, including terrestrial wave DMB, which require a wide bandwidth and a high gain. Accordingly, there is a need for the development of a method of reducing the size of an antenna and satisfying a wide bandwidth and a high gain.

SUMMARY

Accordingly, the present invention has been made in view of the above problems occurring in the prior art, and an object of the present invention is to provide an antenna using a complex structure in which dielectric substances having a low dielectric constant and magnetic substances having a high magnetic permeability are arranged vertically and periodically in order to improve the gain, efficiency, and bandwidth of the antenna while maintaining a small size which is an advantage of a conventional antenna using dielectric substances having a high dielectric constant.

To achieve the above object, the present invention provides an antenna using a complex structure having a vertical and periodic structure of dielectric substances and magnetic substances, comprising a substrate and a radiation patch formed on the substrate. The substrate includes a plurality of layers, and each of the layers has the dielectric substances and the magnetic substances of a bar shape alternately arranged therein and has the dielectric substances and the magnetic substances alternately laminated thereon even in a height direction.

Furthermore, to achieve the above object, the present invention provides an antenna using a complex structure having a vertical and periodic structure of dielectric substances and magnetic substances, comprising a substrate and a radiation patch formed on the substrate. The substrate includes a plurality of layers, each of the layers has the dielectric substances and the magnetic substances of a bar shape alternately arranged therein, and the long axes of the dielectric substances and the magnetic substances are perpendicular to each other.

Preferably, the antenna resonates in multiple bands.

Furthermore, the dielectric substances and the magnetic substances have the cross section of a regular quadrilateral, and the length of each of faces of the dielectric substances and magnetic substances is 5 mm or 10 mm.

More preferably, the dielectric substances have a dielectric constant of 2.2 and a magnetic permeability of 1.0, and the magnetic substances has a dielectric constant of 16 and a magnetic permeability of 16.

Furthermore, the present invention provides a wireless terminal apparatus comprising the above antenna.

As described above, the present invention provides an antenna using a complex structure in which dielectric substances having a low dielectric constant and magnetic substances having a high magnetic permeability are arranged vertically and periodically in order to improve the gain, efficiency, and bandwidth of the antenna while maintaining a small size which is an advantage of a conventional antenna using dielectric substances having a high dielectric constant.

DETAILED DESCRIPTION

In order to fully understand the present invention, operational advantages of the present invention, and objects achieved by the implementation of the present invention, the accompanying drawings illustrating preferred embodiments of the present invention and the contents described in the accompanying drawings need to be referred to.

Hereinafter, preferred embodiments of the present invention will be described in detail with reference to the accompanying drawings.

First Embodiment

Figure 1A:
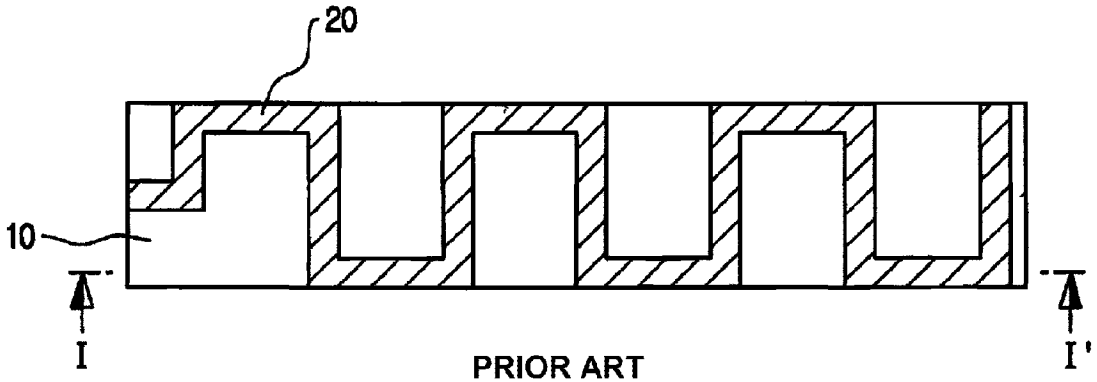
PRIOR ART FIG. 1A
FIG. 1A is a plan view of a PCB antenna which is a conventional built-in type antenna and, FIG. 1B is a cross-sectional view taken along line I-I' of the plan view.
Figure 1B:
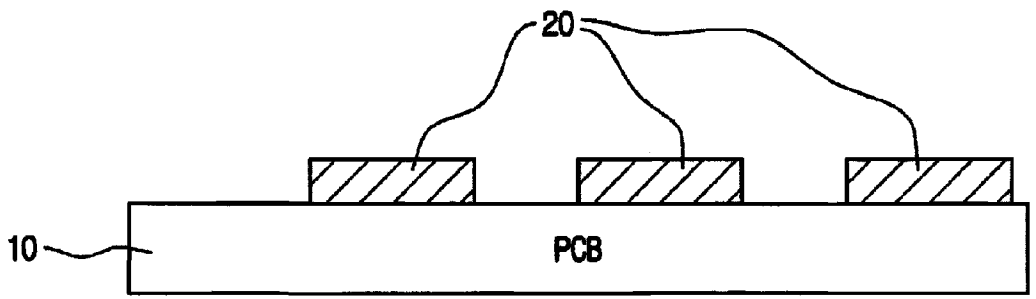
PRIOR ART FIG. 1B
Figure 2:
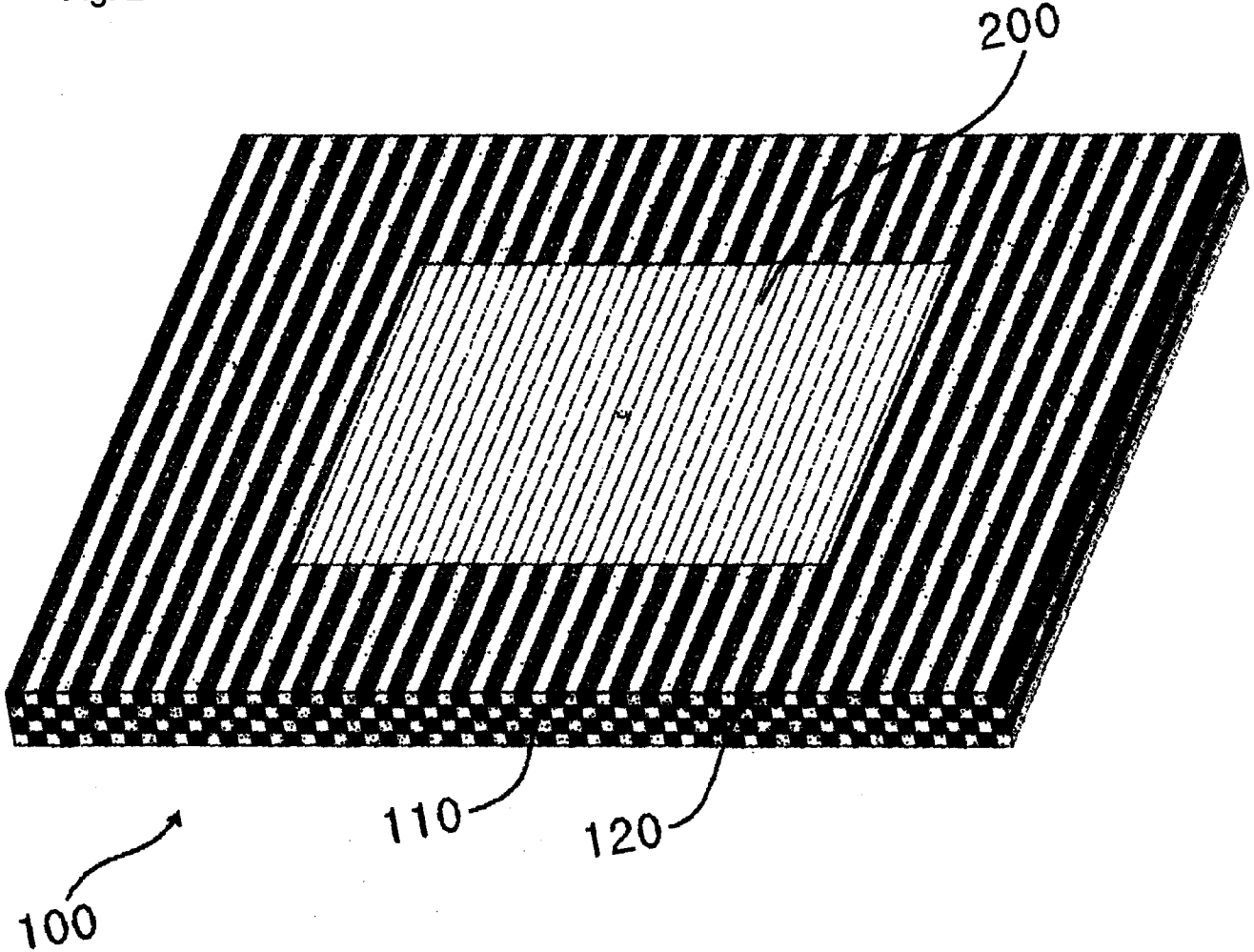
FIG. 2 is a diagram showing an antenna using a complex structure having a multi-vertical and periodic structure of dielectric substances and magnetic substances according to a first embodiment of the present invention.

FIG. 2 is a diagram showing an antenna using a complex structure having a multi-vertical and periodic structure of dielectric substances and magnetic substances according to a first embodiment of the present invention.

Referring to FIG. 2, the antenna according to the first embodiment of the present invention basically includes a first substrate 100 and a radiation patch 200 formed on the first substrate 100. The first substrate 100 has a complex structure having a multi-vertical and periodic structure of dielectric substances 110 and magnetic substances 120. That is, the first substrate 100 is formed of a plurality of layers. Each of the layers has the dielectric substances 110 and the magnetic substances 120 of a bar shape alternately disposed therein and also has the dielectric substances 110 and the magnetic substances 120 alternately laminated thereon even in the height direction.

It is preferred that the dielectric substances 110 include dielectric substances of a low dielectric constant, with a dielectric constant of 2.2 and a magnetic permeability of about 1.0, and the magnetic substances 120 include magnetic substances of a high magnetic permeability, with a dielectric constant of 16 and a magnetic permeability of about 16.

For example, the radiation patch 200 may be 170 mm*170 mm in dimension, and the total dimension of the first substrate 100 may be 300 mm*300 mm*20 mm.

The operational characteristics of the antenna according to the first embodiment of the present invention having the above configuration is described below with reference to drawings below and tables.

Figure 3:
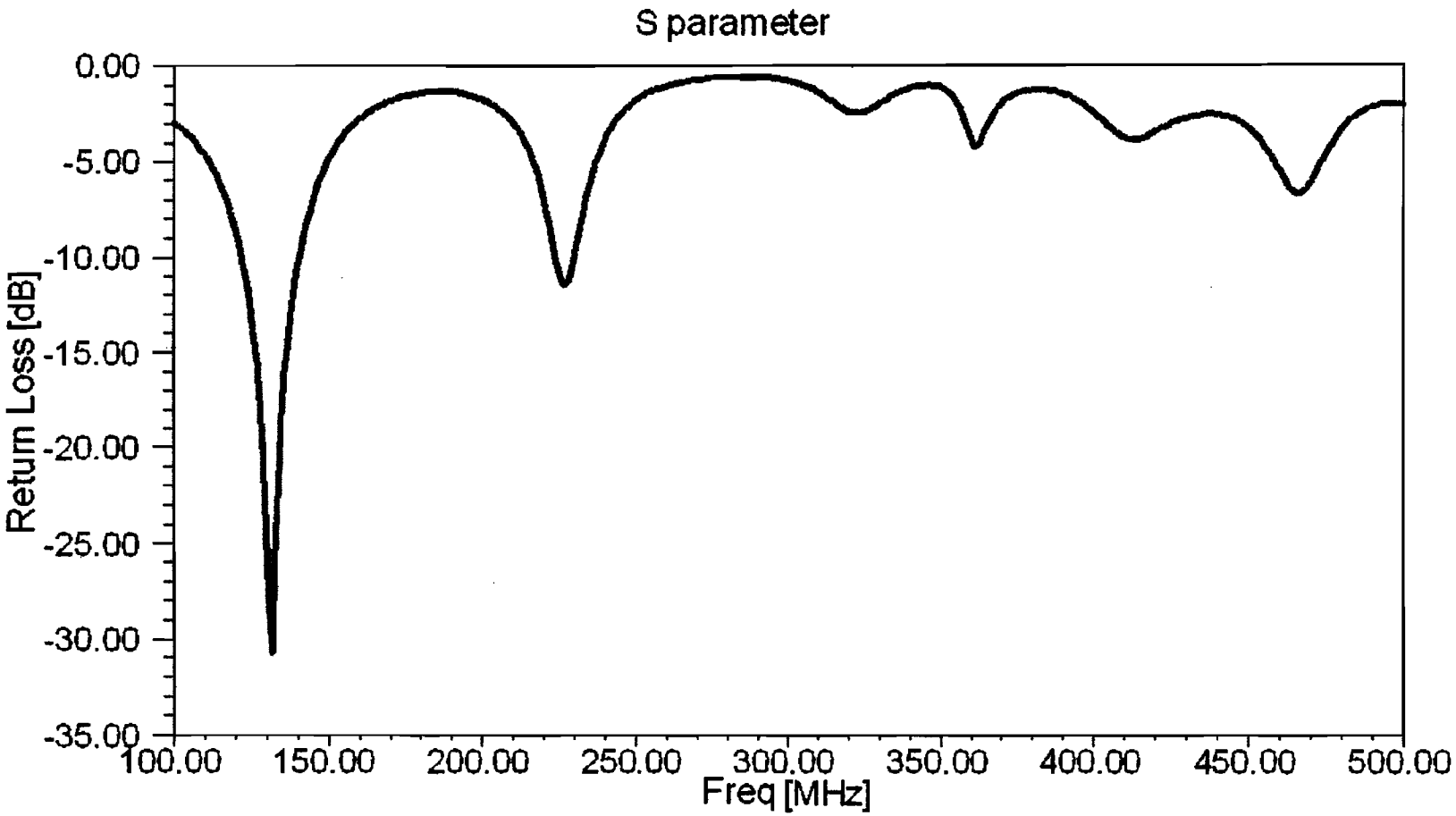
FIGS. 3 and 4 are diagrams showing the reflection loss of the patch antenna implemented on the complex structure having various multi-vertical and periodic structures.
Figure 4:
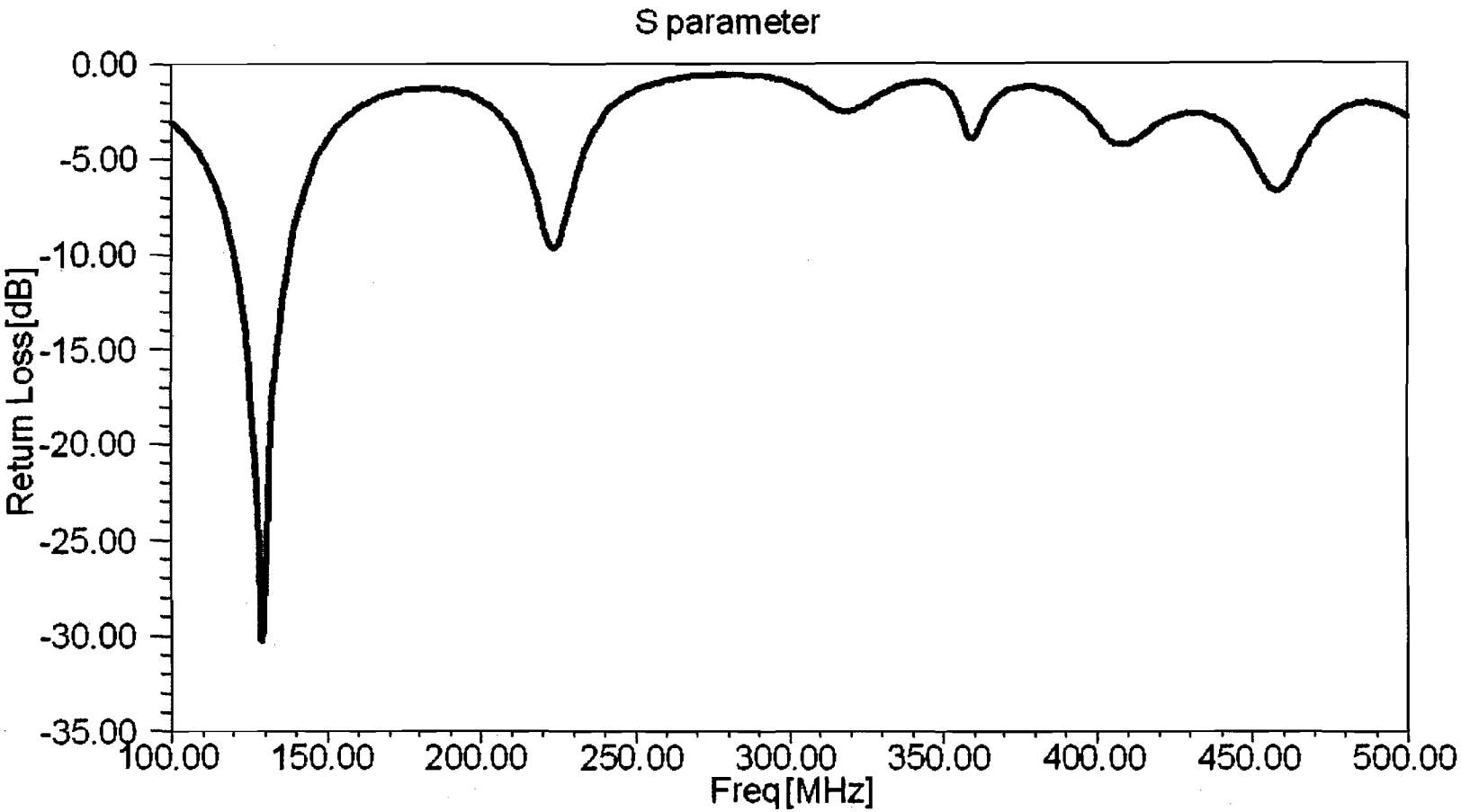

FIGS. 3 and 4 are diagrams showing the reflection loss of the patch antenna implemented on the complex structure having various multi-vertical and periodic structures.

More particularly, FIG. 3 shows a reflection loss in the case where the dielectric substances are vertically arranged in a cycle of 5 mm and the magnetic substances are vertically arranged in a cycle of 5 mm on the first substrate 100. FIG. 4 shows a reflection loss in the case where the dielectric substances are vertically arranged in a cycle of 10 mm and the magnetic substances are vertically arranged in a cycle of 10 mm on the first substrate 100.

In each of the cases in which the dielectric substances and the magnetic substances are vertically arranged, the total length of the first substrate 100 having the multi-vertical and periodic structure is 300 mm as described above, and the layers have the same cycle.

In the above case, it can be seen that a multi-band antenna can be implemented and a high gain and efficiency and a wide bandwidth can be achieved.

Figure 5:
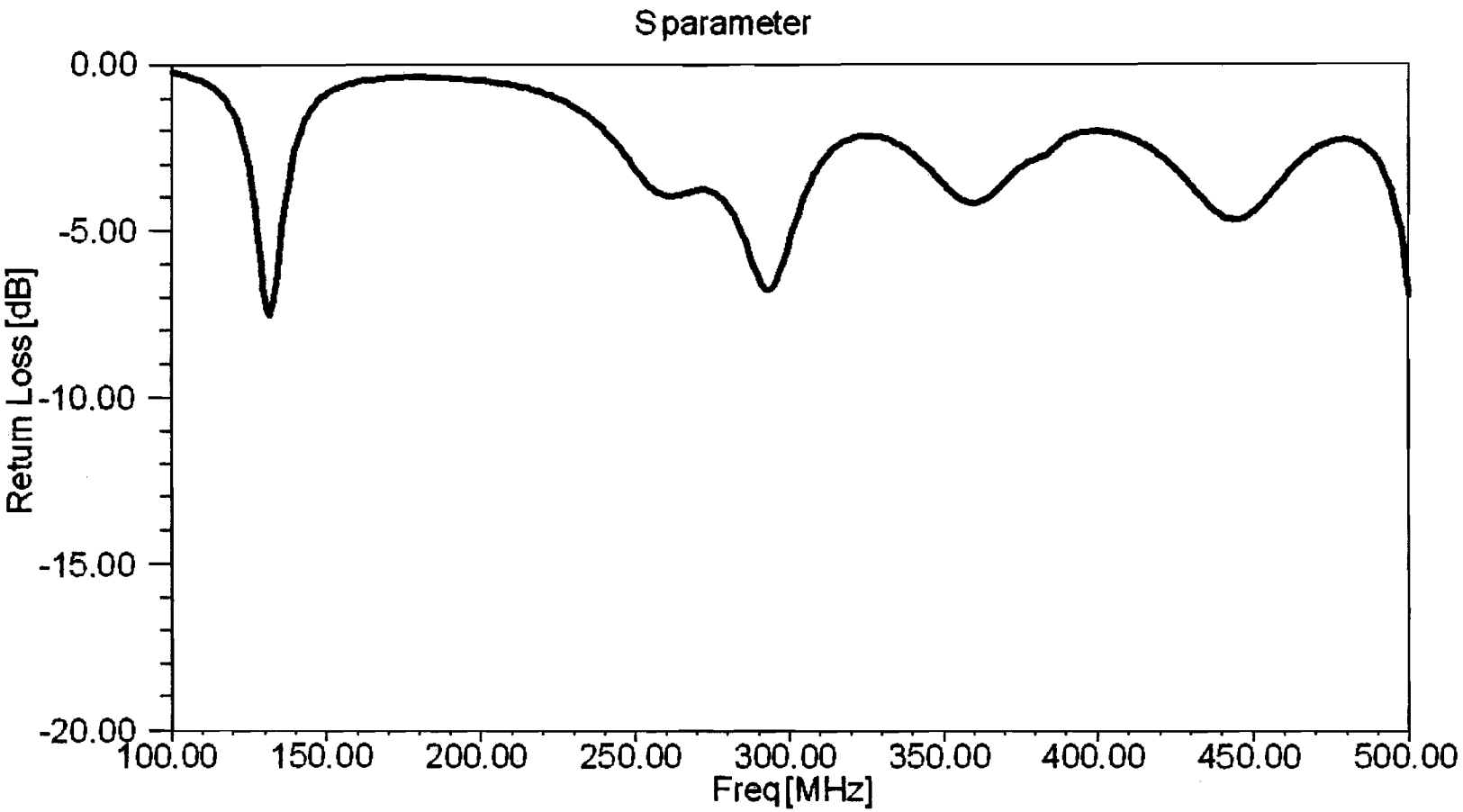
FIG. 5 is a diagram showing the reflection loss of a patch antenna implemented using high dielectric substances of a dielectric constant of about 40 and configured to have the same size as the patch antenna according to the first embodiment of the present invention.

FIG. 5 is a diagram showing the reflection loss of a patch antenna implemented using high dielectric substances of a dielectric constant of about 40 and configured to have the same size as the patch antenna according to the first embodiment of the present invention.

From FIG. 5, it can be seen that a bandwidth is narrow and efficiency is low in the case in which a conventional antenna is implemented using a substrate using high dielectric substances, as compared with the antenna having the first substrate 100 on which the dielectric substances 110 and the magnetic substances 120 are arranged vertically and periodically according to the first embodiment of the present invention.

TABLE 1

| | PATCH SIZE (Λ0) | BANDWIDTH (%) (VSWR = 3) | MAXIMUM GAIN (DBI) | EFFICIENCY (%) |
|---|---|---|---|---|
| CYCLE OF 5 MM | 0.07 | 24.24 | −6.96 | 89.27 |
| CYCLE OF 10 MM | 0.07 | 24.03 | −8.27 | 92.24 |
| DIELECTRIC LAYER (DIELECTRIC CONSTANT = 40) | 0.07 | 3.79 | −9.21 | 49.03 |

Table 1 shows a comparison of the two kinds of configurations disclosed in FIGS. 3 and 4 according to the first embodiment of the present invention and the characteristics of the patch antenna disclosed in FIG. 5.

Here, comparison data is calculation results of a bandwidth, a gain, and efficiency for a first resonance frequency. From Table 1, it can be seen that the two kinds of configurations according to the first embodiment have an improved bandwidth, gain, and efficiency in the same antenna size, as compared with the patch antenna using dielectric substances having a high dielectric constant. Furthermore, various resonance frequencies may be obtained by changing a feed power location for each multi-vertical and periodic structure.

As described above, according to the first embodiment of the present invention, the antenna having a reduced size and having an improved gain, efficiency, and bandwidth and various resonance frequencies can be designed using the complex structure in which the dielectric substances of a low dielectric constant and the magnetic substances of a high magnetic permeability are arranged vertically and periodically.

Second Embodiment

Figure 6:
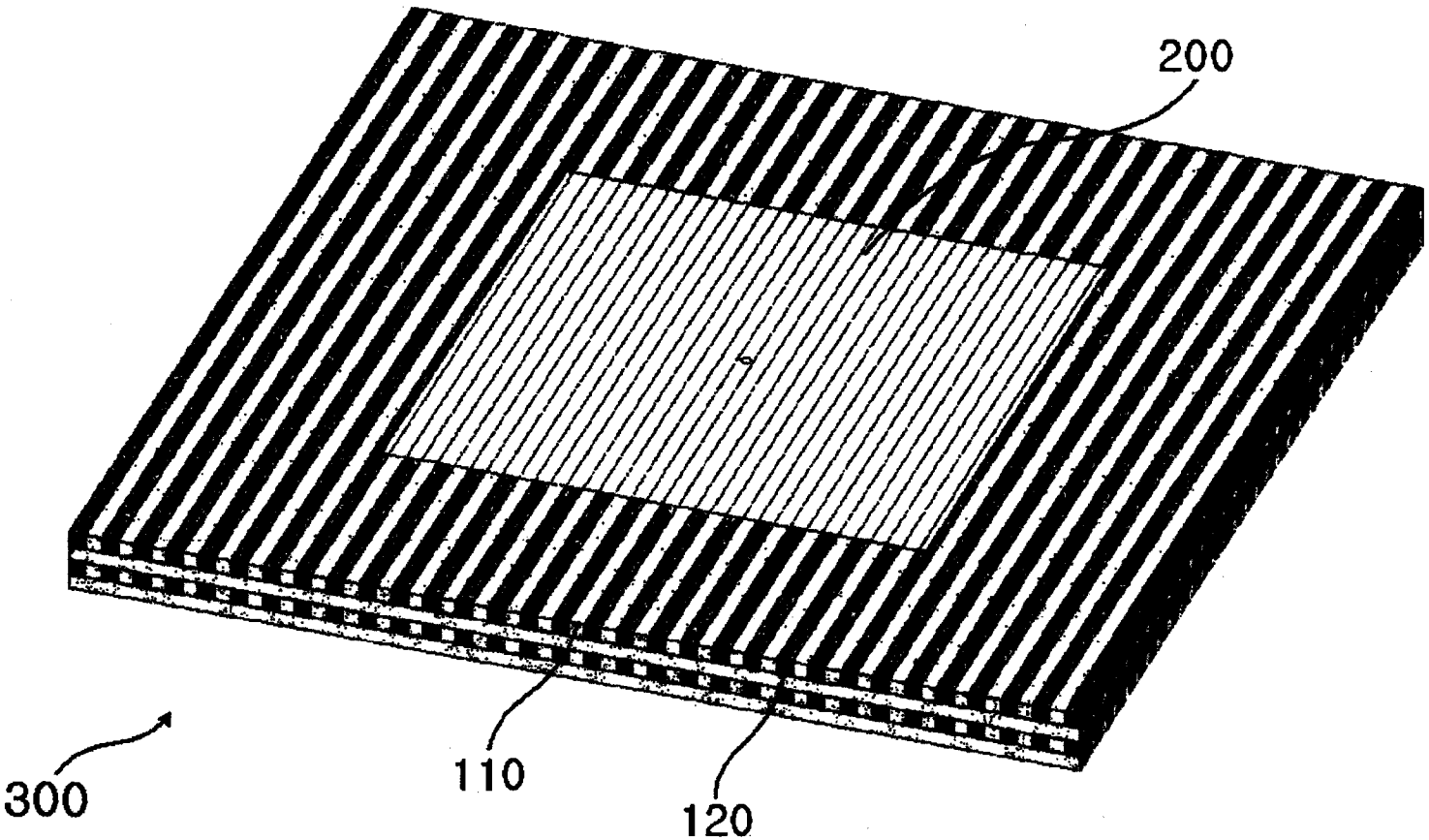
FIG. 6 is a diagram showing an antenna using a complex structure having a crossing vertical and periodic structure of dielectric substances and magnetic substances according to a second embodiment of the present invention.

FIG. 6 is a diagram showing an antenna using a complex structure having a crossing vertical and periodic structure of dielectric substances and magnetic substances according to a second embodiment of the present invention.

Referring to FIG. 6, the antenna of the present invention basically includes a second substrate 300 and a radiation patch 200 formed on the second substrate 300. The second substrate 300 has a complex structure having a crossing vertical and periodic structure of dielectric substances 110 and magnetic substances 120. That is, the second substrate 300 is formed of a plurality of layers. The dielectric substances 110 and the magnetic substances 120 of a bar shape in each of the layers are alternately arranged. The dielectric substances 110 and the magnetic substances 120 of each layer are disposed to cross each other such that the long axes of the dielectric substances 110 and the magnetic substances 120 are perpendicular to each other.

It is preferred that the dielectric substances 110 include dielectric substances of a low dielectric constant, with a dielectric constant of 2.2 and a magnetic permeability of about 1.0, and the magnetic substances 120 include magnetic substances of a high magnetic permeability, with a dielectric constant of 16 and a magnetic permeability of about 16.

For example, the radiation patch 200 may be 170 mm*170 mm in dimension, and the total dimension of the second substrate 300 may be 300 mm*300 mm*20 mm.

The operational characteristics of the antenna according to the present invention having the above configuration is described below with reference to drawings below and tables.

Figure 7:
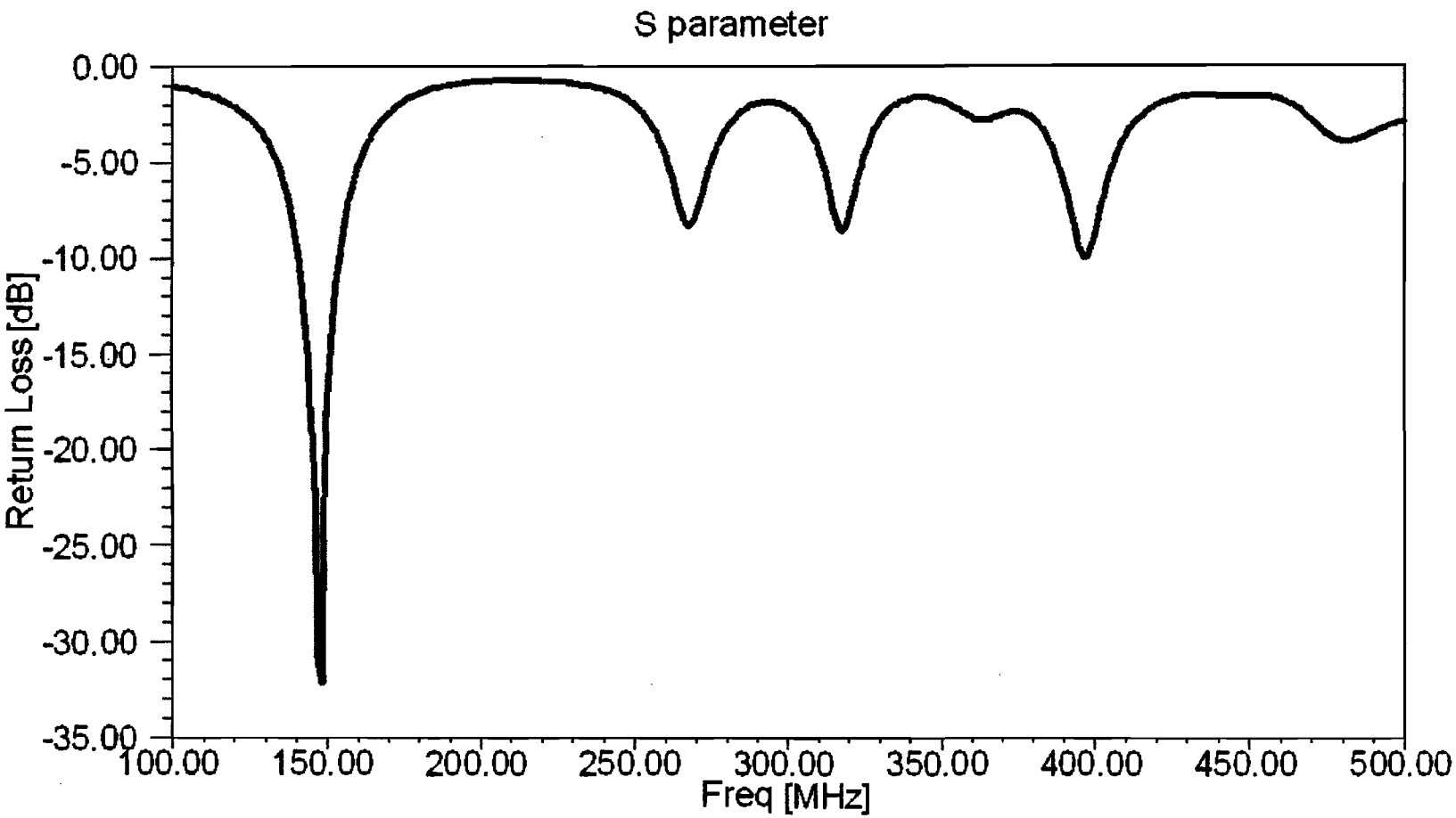
FIGS. 7 and 8 are diagrams showing the reflection loss of the patch antenna implemented on the complex structure having various crossing vertical and periodic structures.
Figure 8:
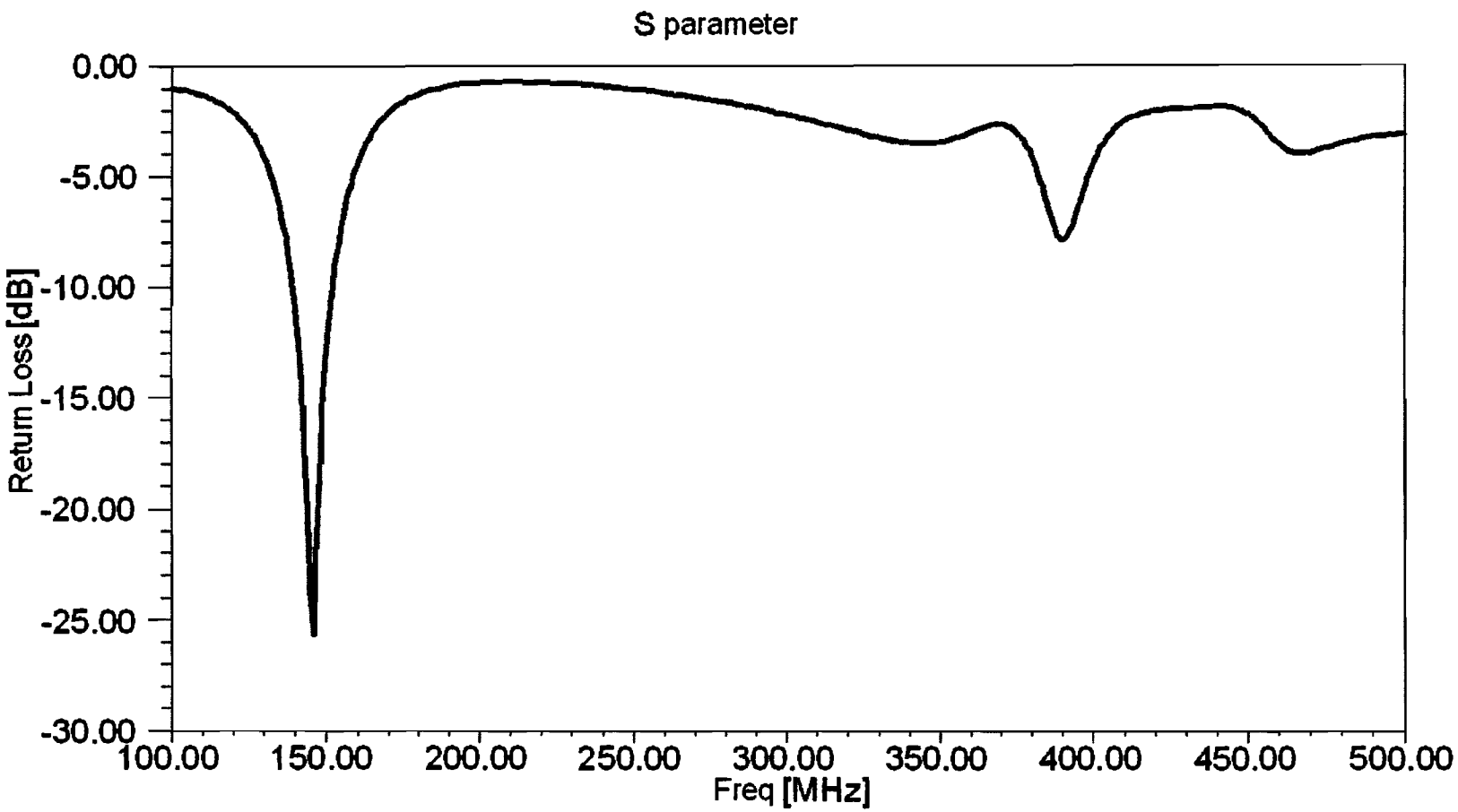

FIGS. 7 and 8 are diagrams showing the reflection loss of the patch antenna implemented on the complex structure having various crossing vertical and periodic structures.

More particularly, FIG. 7 shows a reflection loss in the case where the dielectric substances are vertically arranged in a cycle of 5 mm and the magnetic substances are vertically arranged in a cycle of 5 mm on the second substrate 300. FIG. 8 shows a reflection loss in the case where the dielectric substances are vertically arranged in a cycle of 10 mm and the magnetic substances are vertically arranged in a cycle of 10 mm on the second substrate 300.

In each of the cases in which the dielectric substances and the magnetic substances are vertically arranged, the total length of the second substrate 300 having the multi-vertical and periodic structure is 300 mm as described above, and the layers have the same cycle.

In the above case, it can be seen that a multi-band antenna can be implemented and a high gain and efficiency and a wide bandwidth can be achieved.

Figure 9:
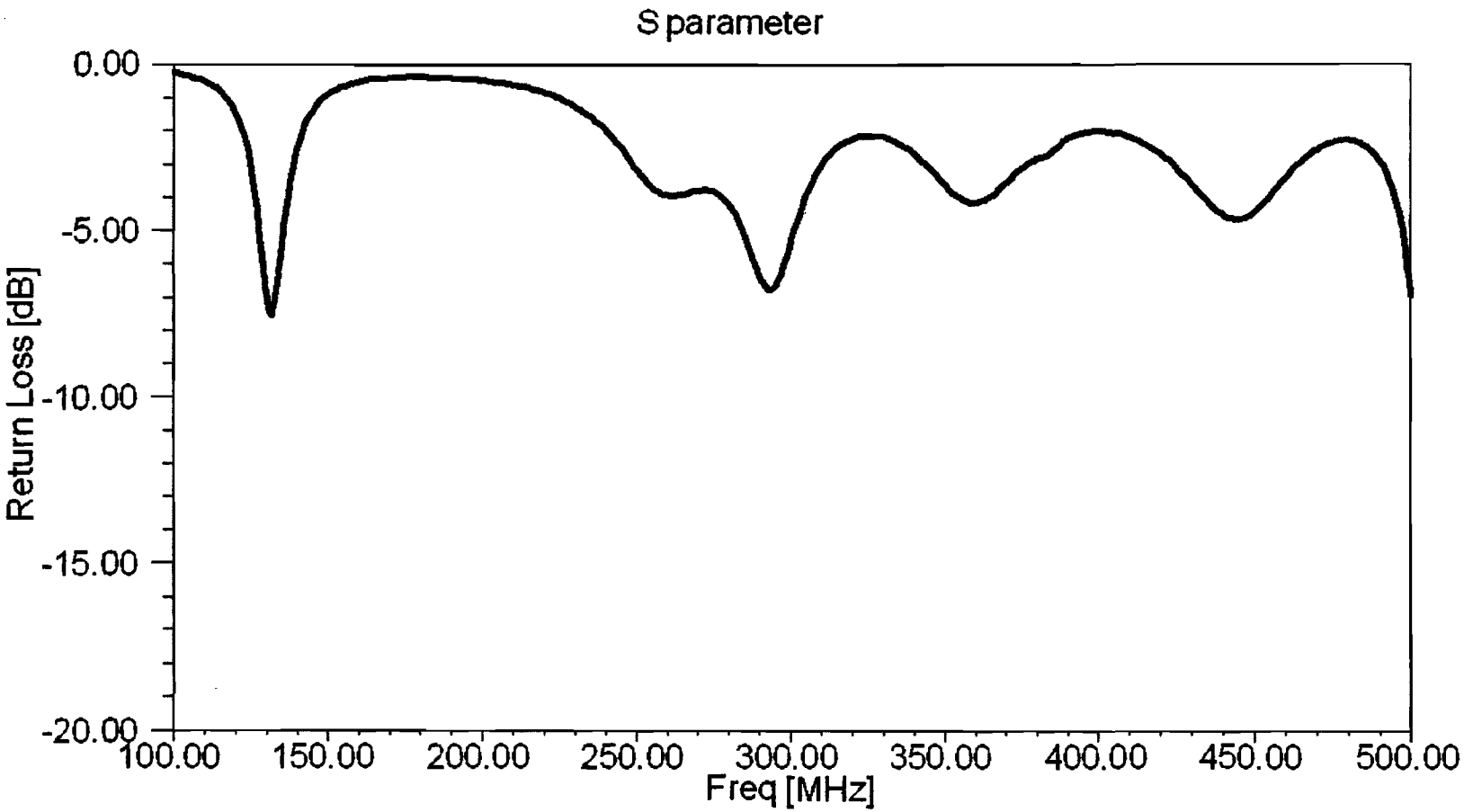
FIG. 9 is a diagram showing the reflection loss of a patch antenna implemented using high dielectric substances of a dielectric constant of about 40 and configured to have the same size as the patch antenna according to the second embodiment of the present invention.

FIG. 9 is a diagram showing the reflection loss of a patch antenna implemented using high dielectric substances of a dielectric constant of about 40 and configured to have the same size as the patch antenna according to the second embodiment of the present invention.

From FIG. 9, it can be seen that a bandwidth is narrow and efficiency is low in the case in which a conventional antenna is implemented using a substrate using high dielectric substances, as compared with the antenna having the second substrate 300 on which the dielectric substances 110 and the magnetic substances 120 are arranged vertically and periodically according to the first embodiment of the present invention.

TABLE 2

| | PATCH SIZE (Λ0) | BANDWIDTH (%) (VSWR = 3) | MAXIMUM GAIN (DBI) | EFFICIENCY (%) |
|---|---|---|---|---|
| CYCLE OF 5 MM | 0.08 | 15.54 | −4.96 | 66.27 |
| CYCLE OF 10 MM | 0.08 | 15.07 | −5.64 | 68.59 |
| DIELECTRIC LAYER (DIELECTRIC CONSTANT = 40) | 0.07 | 3.79 | −9.21 | 49.03 |

Table 2 shows a comparison of the two kinds of configurations disclosed in FIGS. 7 and 8 according to the second embodiment of the present invention and the characteristics of the antenna including dielectric substances of a high dielectric constant disclosed in FIG. 9.

Here, comparison data is calculation results of a bandwidth, a gain, and efficiency for a first resonance frequency. From Table 2, it can be seen that the two kinds of configurations according to the second embodiment have an improved bandwidth, gain, and efficiency in the same antenna size, as compared with the case where dielectric substances of a high dielectric constant are used. Furthermore, various resonance frequencies may be obtained by changing a feed power location for each crossing vertical and periodic structure.

Although the embodiments of the present invention have been described with reference to the accompanying drawings, they are only illustrative. Those skilled in the art will appreciate that various modifications are possible. Accordingly, the true technical scope of the present invention should be defined by the technical spirit of the claims.

What is claimed is:

1. An antenna using a complex structure having a vertical and periodic structure of dielectric substances and magnetic substances, the antenna comprising:

a substrate; and a radiation patch formed on the substrate, wherein the substrate includes a plurality of layers, and each of the layers has the dielectric substances and the magnetic substances of a bar shape alternately arranged therein and has the dielectric substances and the magnetic substances alternately laminated thereon even in a height direction.

2. The antenna according to claim 1, wherein the antenna resonates in multiple bands.

3. The antenna according to claim 1, wherein:

the dielectric substances and the magnetic substances has a cross section of a regular quadrilateral, and a length of each of faces of the dielectric substances and magnetic substances is 5 mm or 10 mm.

4. The antenna according to claim 3, wherein:

the dielectric substances has a dielectric constant of 2.2 and a magnetic permeability of 1.0, and the magnetic substances have a dielectric constant of 16 and a magnetic permeability of 16.

5. A wireless terminal apparatus comprising an antenna using a complex structure having a vertical and periodic structure of dielectric substances and magnetic substances, the antenna comprising:

a substrate; and a radiation patch formed on the substrate, wherein the substrate includes a plurality of layers, and each of the layers has the dielectric substances and the magnetic substances of a bar shape alternately arranged therein and has the dielectric substances and the magnetic substances alternately laminated thereon even in a height direction.

6. An antenna using a complex structure having a vertical and periodic structure of dielectric substances and magnetic substances, the antenna comprising:

a substrate; and a radiation patch formed on the substrate, wherein the substrate includes a plurality of layers, each of the layers has the dielectric substances and the magnetic substances of a bar shape alternately arranged therein, and long axes of the dielectric substances and the magnetic substances are perpendicular to each other.

7. The antenna according to claim 6, wherein the antenna resonates in multiple bands.

8. The antenna according to claim 6, wherein:

the dielectric substances and the magnetic substances has a cross section of a regular quadrilateral, and a length of each of faces of the dielectric substances and magnetic substances is 5 mm or 10 mm.

9. The antenna according to claim 8, wherein:

the dielectric substances has a dielectric constant of 2.2 and a magnetic permeability of 1.0, and the magnetic substances have a dielectric constant of 16 and a magnetic permeability of 16.

10. A wireless terminal apparatus comprising an antenna using a complex structure having a vertical and periodic structure of dielectric substances and magnetic substances, the antenna comprising:

a substrate; and a radiation patch formed on the substrate, wherein the substrate includes a plurality of layers, each of the layers has the dielectric substances and the magnetic substances of a bar shape alternately arranged therein, and long axes of the dielectric substances and the magnetic substances are perpendicular to each other.

* * * * *